United States Patent [19]

Richmond

[11] 4,370,757

[45] Feb. 1, 1983

[54] GARMENT WITH A MODESTY PANEL

[76] Inventor: Bonnie D. Richmond, 11206 Martha, Omaha, Nebr. 68134

[21] Appl. No.: 359,946

[22] Filed: Mar. 19, 1982

[51] Int. Cl.[3] ..... A41B 9/00

[52] U.S. Cl. ..... 2/400; 2/114; 2/DIG. 7

[58] Field of Search ..... 2/400, 114, DIG. 7, 2/74

[56] References Cited

U.S. PATENT DOCUMENTS 2,336,008 12/1943 Goodman ..... 2/114 UX 2,886,822 5/1959 Matthews ..... 2/114

*Primary Examiner*—Doris L. Troutman

*Attorney, Agent, or Firm*—Zarley, McKee, Thomte, Voorhees & Sease

[57] ABSTRACT

A garment including a modesty panel is described which is designed for patients of hospitals or nursing homes. The garment comprises first and second garment portions which have upper and lower ends and inner and outer side edges. The first and second garment portions are joined at their upper inner side edges to form a body portion which may be wrapped around the person to cover the lower abdomen, thighs and buttocks of the person. The lower ends of the first and second garment portions have ankle receiving portions adapted to receive the ankles of the person. The garment portions have a width sufficient, between the body portion and the ankle receiving portions, to enable the first and second garment portions to be wrapped around the person's legs. A foldable modesty panel is provided at the juncture of the upper inner side edges of the garment portions. The modesty panel extends downwardly from the body portion and covers the person's genital area whether the person is standing, sitting or reclining.

3 Claims, 5 Drawing Figures

GARMENT WITH A MODESTY PANEL

BACKGROUND OF THE INVENTION

This invention relates to a garment and more particularly to a garment suitable for use in a hospital or nursing home.

Hospital gowns have been designed to facilitate the convenient placement on a patient. Ordinarily, the hospital gowns are wrapped around the front of the person and are tied together at the back. The lower back portion of the gowns ordinarily do not join and leaves the person's buttock area exposed. Further, the gowns ordinarily do not cover the person's genital area especially when the person is reclining or sitting in a wheelchair or the like.

Therefore, it is a principal object of the invention to provide an improved garment especially adapted for use in a hospital or nursing home.

A further object of the invention is to provide a garment which is easily placed on a patient whether the patient is reclining in bed or sitting in a wheelchair or the like.

A further object of the invention is to provide a garment having a modesty panel provided thereon which covers the patient's genital area.

A still further object of the invention is to provide a garment including a modesty panel which automatically falls downwardly from the garment to cover a person's genital area.

These and other objects will be apparent to those skilled in the art.

SUMMARY OF THE INVENTION

Figure 3:
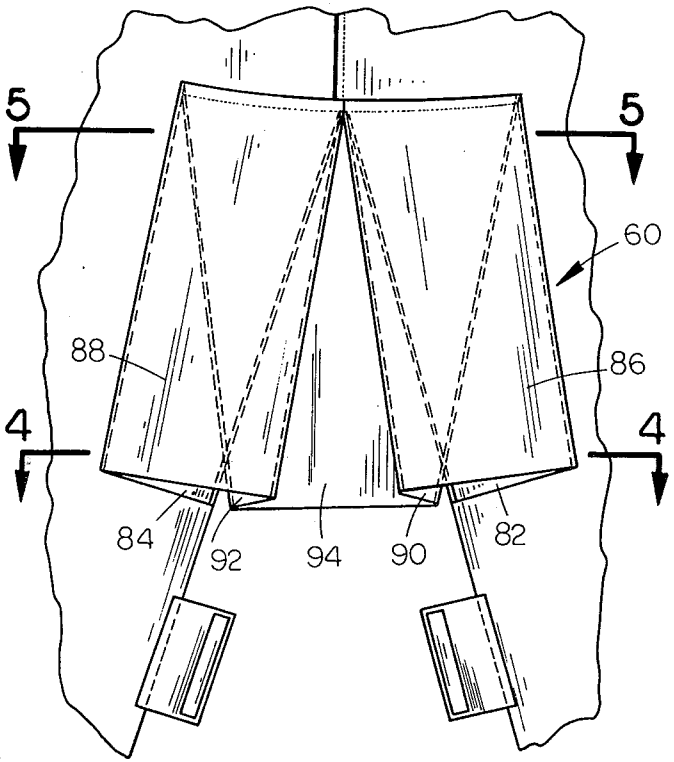
FIG. 3 is a partial back elevational view of the garment illustrating the modesty panel.

A garment is disclosed comprising first and second garment portions having upper and lower ends and inner and outer side edges. The upper inner side edges of the garment portions are joined together to create a body portion adapted to be wrapped round the patient's lower abdomen, upper thighs and buttocks. The lower ends of the garment portions have ankle receiving portions adapted to receive the ankles of the patient. Straps having Velcro fasteners thereon are secured to the garment portions above the ankles portions to permit the garment portions to be wrapped around the patient's legs and maintained thereon. A foldable modesty panel is secured to the garment portions at the juncture of the upper inner side edges thereof. The foldable panel is comprised of a panel member folded upon itself and secured at its upper end to the body portion so that the panel portion will automatically fall downwardly, by gravity to cover the patient's genital area whether the patient is reclining or sitting.

DESCRIPTION OF THE PREFERRED EMBODIMENT

The numeral 10 refers generally to the garment of this invention. Garment 10 includes garment portions 12 and 14 joined together at 16 to define a body portion 18 and leg portions 20 and 22. For purposes of description, garment portion 12 will be described as comprising an upper end 24 and side edges 26 and 28. Garment portion 14 will be described as comprising an upper end 30 and side edges 32 and 34.

Upper ends 24 and 30 are folded upon themselves to form a channel or pocket into which extend eye strings 36 and 38. The inner ends of the tie strings 36 and 38 are sewn to the channel in conventional fashion. If desired, a single tie string could be extended through the channel or pocket.

The lower ends of leg portions 20 and 22 are joined together to form loop or ankle receiving portions 40 and 42 respectively. Preferably, elastic is provided in the ankle receiving portions 40 and 42 to aid in maintaining the lower ends of the leg portions in position.

Figure 4:
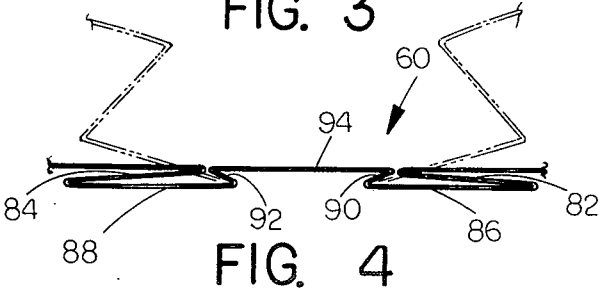
FIG. 4 is a sectional view seen on lines 4—4 of FIG. 3.
Figure 5:
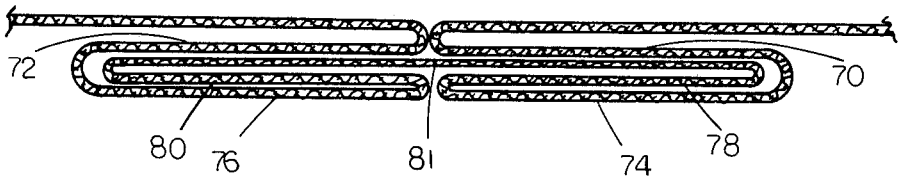
FIG. 5 is a sectional view seen on lines 5—5 of FIG. 3.

Straps 44 and 46 having Velcro connectors 48 and 50 thereon respectively are provided on leg portion 20 as illustrated. Likewise, straps 52 and 54 having Velcro fasteners 56 and 58 are provided on leg portion 22. The numeral 60 designates a modesty panel which is secured to the garment at the juncture of side edges 28 and 34 of leg portions 20 and 22. Panel 60 includes an upper edge 62, lower edge 64 and opposite side edges 66 and 68. Side edges 66 and 68 are sewn to the upper inside edges 28 and 34 of leg portions 20 and 22 respectively as seen in the drawings. Upper edge 62 is folded upon itself as illustrated in FIGS. 3, 4 and 5 to define first and second upper edge portions 70 and 72 which extend outwardly from the juncture of the leg portions. Third and fourth upper edge portions 74 and 76 extend inwardly from the outer ends of edge portions 70 and 72 respectively. Fifth and sixth upper edge portions 78 and 80 extend outwardly from the inner ends of edge portions 74 and 76 between edge portions 74-76 and 70-72. The attachment and folding of the upper edge portions of the panel creates panel portions 82, 84, 86, 88 and 90.

In use, the garment 10 is easily placed on person or patient whether the patient is reclining in bed or sitting in a wheelchair or the like. The ankle receiving portions 40 and 42 are simply slipped over the feet of the patient so that the ankle receiving portions 40 and 42 are wrapped around the ankles of the patient. The upper portion of the body portion is positioned at the person's waist and the tie strings 36 and 38 are wrapped around the back of the person. Preferably, the tie strings 36 and 38 have a length sufficient so that they may be wrapped completely around the person and tied in the front of the person. The straps 46, 48, 54 and 52 are then secured in conventional fashion to wrap the leg portions around the legs of the person.

Figure 2:
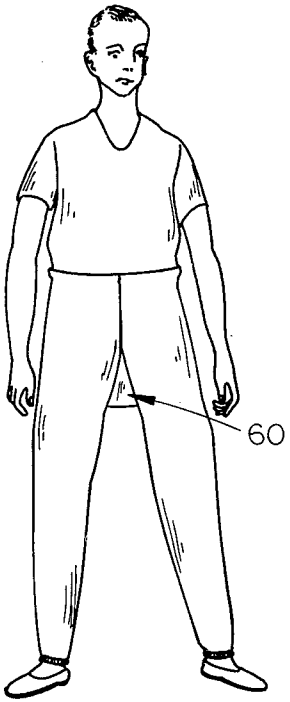
FIG. 2 is a front view of the invention positioned on a person.
Figure 1:
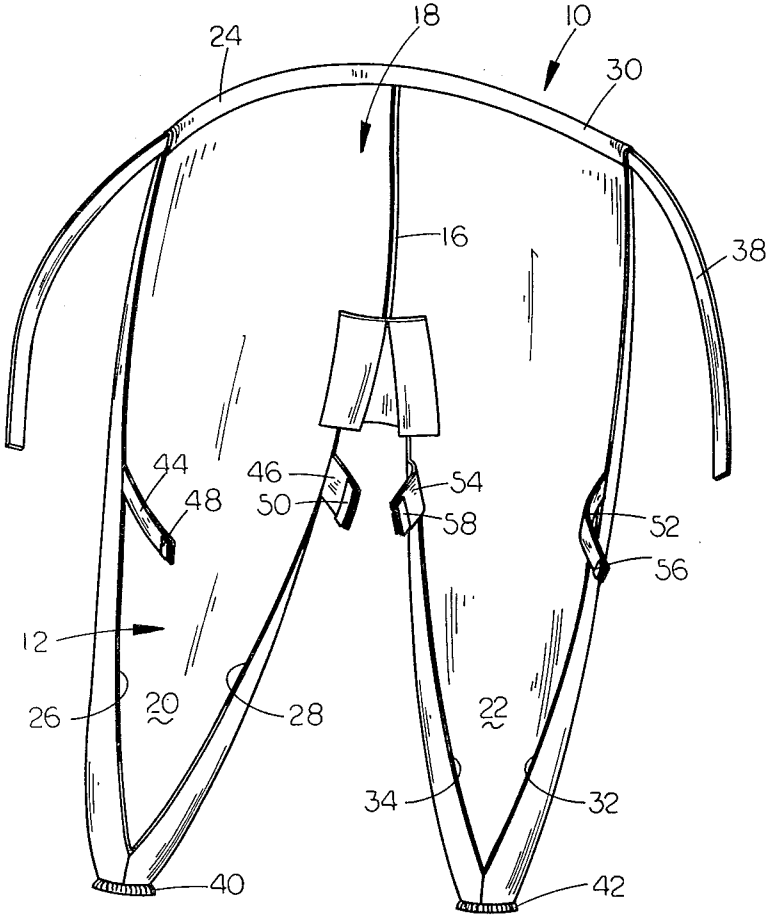
FIG. 1 is a back plan view of the garment of this invention.

The modesty panel 60 is the most important part of the invention and is designed so that it will cover the genital area of the person whether the person is reclining, standing or sitting in a wheelchair or the like. When a person is standing, as illustrated in FIG. 2, the modesty panel 60 extends downwardly from the juncture of the leg portions to cover the genital area. If the person is reclining or sitting, the foldable panel portions automatically drop or fall downwardly, by gravity, between the legs of the person so that the genital area of the person will be covered. The foldable relationship of the panel portions also insures that the patient will have sufficient mobility.

Thus it can be seen that a novel garments has been provided which is not only easy to place on a patient and to remove therefrom, but which covers the person's genitals at all times. Thus it can be seen that the garment of this invention accomplishes at least all of its stated objectives.

I claim:

1. A garment comprising, first and second garment portions each having upper and lower ends and inner and outer side edges, said first and second garment portions being joined together at their upper inner side edges to form a body portion which may be wrapped around a person to cover the lower abdomen, thighs and buttocks of the person, means for maintaining said body portion on the person, said first and second garment portions having means at their lower ends forming ankle receiving portions, said first and second garment portions having a width sufficient, between said body portion and said ankle receiving portions, to enable said first and second garment portions to be wrapped around the person's legs, means on said first and second garment portions above said ankle receiving portions to maintain said garment portions on the person's legs, and a foldable modesty panel at the juncture of said upper inner side edges of said first and second garment portions extending downwardly therefrom for covering the person's genital area.

2. The garment of claim 1 wherein said foldable modesty panel comprises a panel member having upper and lower ends and side edges, the upper end of said panel member being folded upon itself and secured to said body portion and being secured at its side edges to said inner side edges of said first and second garment portions to form a plurality of folded panel portions.

3. The garment of claim 1 wherein said folded panel portions automatically drop downwardly, by gravity, relative to said garment portions to cover the person's genital area when the person is sitting or reclining.

* * * * *